US006796767B2

(12) United States Patent
Bouru

(10) Patent No.: US 6,796,767 B2
(45) Date of Patent: Sep. 28, 2004

(54) DEVICE FOR CONTROLLING A VARIABLE-ANGLE VANE VIA A SLACK-FREE CONNECTION

(75) Inventor: Michel Bouru, Montereau sur le Jard (FR)

(73) Assignee: Snecma Moteurs, Paris (FR)

( * ) Notice: Subject to any disclaimer, the term of this patent is extended or adjusted under 35 U.S.C. 154(b) by 78 days.

(21) Appl. No.: 10/352,123

(22) Filed: Jan. 28, 2003

(65) Prior Publication Data

US 2003/0143066 A1 Jul. 31, 2003

(30) Foreign Application Priority Data

Jan. 29, 2002 (FR) ..... 02 01022

(51) Int. Cl.[7] ..... F01B 25/02

(52) U.S. Cl. ..... 415/160; 403/286; 403/291; 403/61; 403/73

(58) Field of Search ..... 415/229, 159, 415/160, 161, 162; 403/286, 291, 292, 239, 52, 61, 65, 73

(56) References Cited

U.S. PATENT DOCUMENTS 2,842,305 A * 7/1958 Eckenfels et al. ..... 415/160
3,841,788 A * 10/1974 Sljusarev et al. ..... 415/160
4,314,791 A * 2/1982 Weiler ..... 415/159
5,024,580 A 6/1991 Olive
5,407,322 A 4/1995 Charbonnel et al.
6,019,574 A * 2/2000 DiBella ..... 415/160
6,688,846 B2 * 2/2004 Caubet et al. ..... 403/61

FOREIGN PATENT DOCUMENTS

EP 1 010 862 A2 6/2000
FR 2 599 785 12/1987

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

A device for controlling a variable-angle vane for a stator of a turbomachine compressor, the device comprising a link, connection means forming a hinge between a first end of the link and a control ring, and fixing means for fixing a second end of the link on a pivot of a vane to be controlled, a radial recess formed in the vane pivot for receiving the second end of the link, the recess having at least one plane edge inclined relative to a longitudinal midplane of the recess and co-operating with a corresponding inclined edge of the second end of the link, and a clamping cap bearing against the second end of the link and on which the fixing means act, the clamping cap having an inside surface providing plane contact with the outside face of the second end of the link in order to maintain the second end of the link against the vane pivot without slack by means of contact between theinclined edges.

10 Claims, 1 Drawing Sheet

DEVICE FOR CONTROLLING A VARIABLE-ANGLE VANE VIA A SLACK-FREE CONNECTION

BACKGROUND OF THE INVENTION

The present invention relates to controlling vanes having a variable setting angle. A particular application for the invention lies in the field of aviation, in particular for controlling the angular positions of air inlet guide vanes in the compressors of turbomachines, such as airplane turbomachines.

Known devices for controlling variable-setting vanes in a turbomachine generally comprise a control member in the form of a ring surrounding the casing of the turbomachine and a plurality of levers or links, each link having a first end connected to the control ring via a hinge and a second end mounted on the pivot of a respective vane.

The angular position of the vanes is changed synchronously by turning the ring about the axis of the turbomachine. In order to be able to follow the turning movement of the ring, the connection between each link and the ring has at least one degree of freedom in rotation about an axis extending substantially radially relative to the ring. Nevertheless, since the link is rigidly mounted to the pivot of the corresponding vane, turning the ring induces other relative movements between the ring and the portion of the link mounted on the vane pivot. In order to accommodate these additional movements, or at least some of them, it is known to make the connection in the form of a ball-and-socket joint or an analogous part which, in addition to turning about an axis that is substantially radial relative to the ring, also allows turning to take place about an axis that is substantially circumferential in direction relative to the ring. Proposals have also been made for a connection that offers an additional degree of freedom in translation in a direction that is substantially radial relative to the ring. Reference can be made to documents FR-A-2 608 678 or FR-A-2 746 141, amongst others.

U.S. Pat. No. 6,019,574 discloses a mechanical hinge between the vane pivot and the end of the link mounted thereon by means of a tenon-and-mortise system: the vane pivot has a threaded end passing through an orifice pierced through the control link. A nut tightened onto the threaded end of the pivot enables this assembly of parts to turn together. Similarly, in European patent application EP 1 010 862 a hinge is described that is obtained by drive studs secured to the vane pivot and penetrating into slots formed at the end of the link mounted on the pivot. That assembly is likewise caused to rotate as a whole by means of a nut screwed onto a threaded end of the vane pivot.

Nevertheless, in those documents, the precision with which the control link turns relatively to the vane pivot leaves an error in the range 0.4° to 0.6° in common practice. This low level of precision stems from the fact that clearance exists between the various parts due to the assembly tolerances of the control device. Slack occurs in particular between the pivot and the end of the link mounted thereon. This gives rise to lack of precision in turning the link which is particularly harmful to proper operation of the assembly.

OBJECT AND SUMMARY OF THE INVENTION

The present invention thus seeks to mitigate such drawbacks by proposing a control device using fixing means for the link which enable it to be held without slack on the vane pivot. Another object of the invention is to eliminate lack of precision in turning.

To this end, the invention provides a device for controlling a variable-angle vane for a stator of a turbomachine compressor, the device comprising a link, connection means forming a hinge between a first end of the link and a control ring, and fixing means for fixing a second end of the link on a pivot of a vane to be controlled, the device further comprising: a radial recess formed in the vane pivot for receiving the second end of the link, said recess having at least one plane edge inclined relative to a longitudinal midplane of the recess and co-operating with a corresponding inclined edge of the second end of the link; and a clamping cap bearing against the second end of the link and on which the fixing means act, said clamping cap having an inside surface providing plane contact with the outside face of the second end of the link against which said clamping cap bears in order to maintain the second end of the link against the vane pivot without slack by means of contact between said inclined edges.

As a result, the second end of the link is positioned without slack on the vane pivot by means of the inclined planes made in the radial recess and the second end of the link. The second end of the link is prevented from moving on the vane pivot by means of the clamping cap, and it is prevented from turning relative thereto by the fixing means. Thus, the precision of the turning drive imparted by the link to the vane pivot is improved.

A groove formed in the inside surface of the clamping cap and in which part of the second end of the link is engaged serves advantageously to prevent the clamping cap from turning relative to the other parts.

The radial recess formed in the vane pivot advantageously presents two inclined planes that are symmetrical about a longitudinal midplane of the recess so as to ensure that the link is held symmetrically on the vane pivot. The two inclined plane edges may also be asymmetrical about the midplane of the recess in order to provide keying distinguishing between a leading edge and a trailing edge of the link.

BRIEF DESCRIPTION OF THE DRAWING

Other characteristics and advantages of the present invention appear from the following description made with reference to the accompanying drawing which show an embodiment that has no limiting character. In the figures.

DETAILED DESCRIPTION OF AN EMBODIMENT

Figure 1:
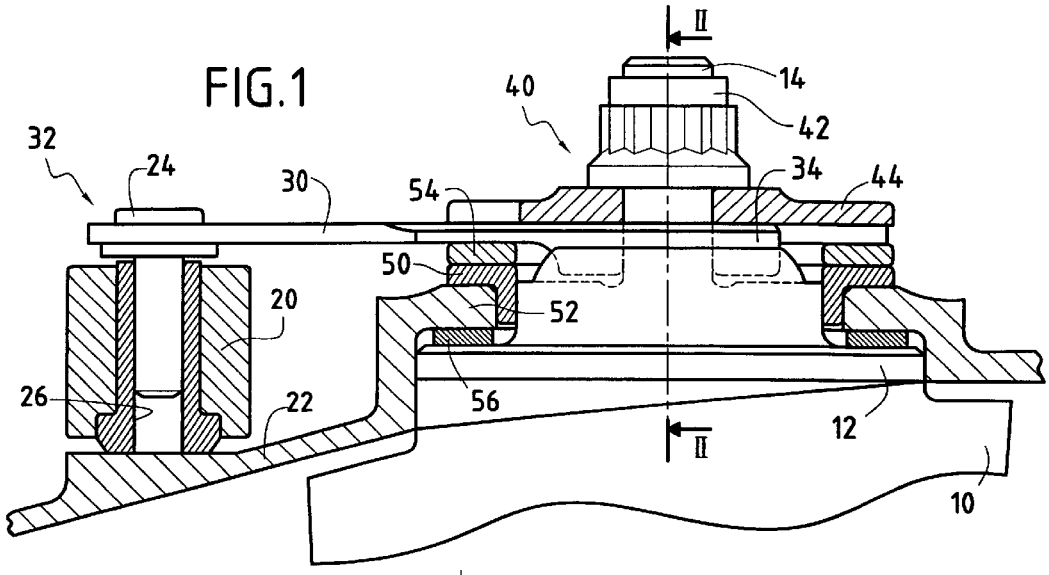
FIG. 1 is a longitudinal section view of a control device of the invention.

FIG. 1 shows a small part of a turbomachine, e.g. an airplane turbojet, provided with vanes 10 of variable setting angle. By way of example, these vanes are guide vanes at the inlet to a compressor of the turbomachine, and they are distributed around the axis of the turbomachine. In FIG. 1, only one vane is shown.

In well-known manner, the angular position of the vanes 10 is controlled by means of a control ring 20 surrounding a casing 22 of the turbomachine (shown in part only in FIG. 1), and a plurality of links 30. Each link 30 has a first end 32 connected to the control ring 20 via hinge-forming connection means. For example the hinge is constituted by a pin or finger 24 passing through the first end 32 of the link 30 and engaged in a housing 26 in the control ring 20.

A second end 34 of the link 30 is mounted on a pivot 12 of the vane 10 via fixing means 40. The fixing means 40 shown in FIG. 1 are conventionally formed by a screw-and-nut system comprising an axial threaded rod 14 secured to the pivot 12 of the vane, and a clamping nut 42. The fixing means may also be in the form of a separate screw and a self-braking bushing (not shown) implanted in the pivot 12 of the vane if the axial extent of the vane pivot allows such a bushing to be fitted. Under such circumstances, an orifice is formed axially in the vane pivot for receiving the separate screw.

Figure 2:
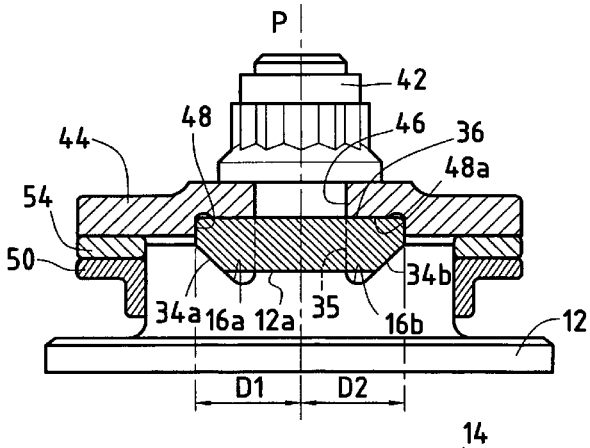
FIG. 2 is a section view on plane II—II of FIG. 1.
Figure 3:
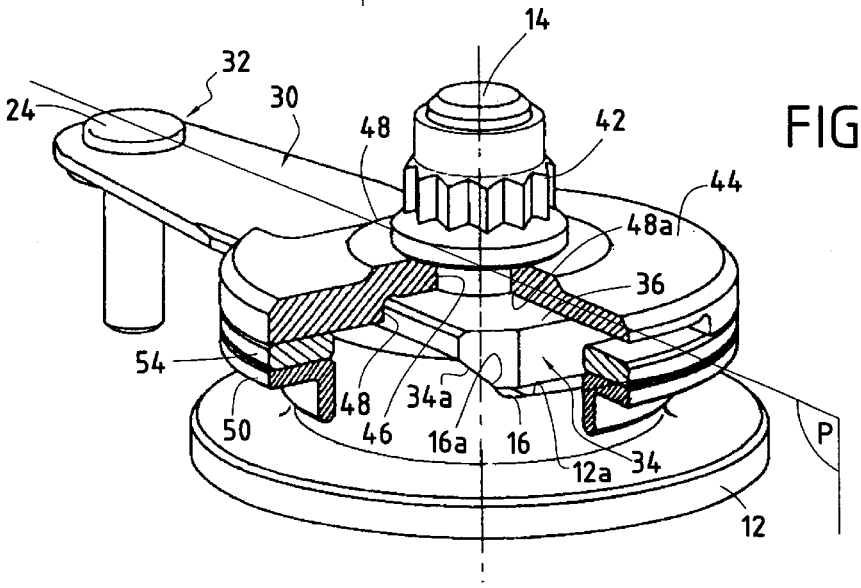
FIG. 3 is a cutaway perspective view of the FIG. 1 control device.

FIGS. 2 and 3 show in greater detail an embodiment of a connection in accordance with the invention between the link and the vane pivot.

A radial recess 16 is formed in the top face 12*a* of the pivot 12 of the vane 10 from which the threaded rod 14 projects. The radial recess 16 is defined laterally by plane edges 16*a*, 16*b* inclined relative to the longitudinal midplane P of the recess 16 and of the link 30. The angle of inclination lies in the range 35° to 55°, for example.

The second end 34 of the link 30 provided with an orifice 35 for passing the threaded rod 14 (or the separate screw) is engaged in the radial recess 16 over a fraction of its thickness defined by two lateral edges 34*a*, 34*b* that are inclined relative to the longitudinal midplane P of the link. The angles of inclination of the edges 34*a* and 34*b* correspond to those of the edges 16*a* and 16*b* of the recess 16 against which they bear.

A cap 44 provided with a hole 46 for passing the threaded rod 14 (or the separate screw) bears against a plane outside face 36 of the second end 34 of the link. In the example shown, this bearing takes place via the plane bottom 48*a* of a groove 48 formed radially in the cap 44 and matching the shape of the second end 34 of the link in the portion thereof that is adjacent to the face 36.

The axial clamping force exerted by the nut 42 (or by the separate screw) against the cap 44 is transmitted via the plane contact between the plane surfaces 36 and 48*a*, and it serves to maintain the inclined edges 34*a*, 34*b* of the link 30 against the inclined edges 16*a*, 16*b* of the recess 16 so that a connection without slack in turning is established between the link 30 and the vane pivot 12.

In the example shown, the edges 34*a*, 34*b* are inclined symmetrically about the longitudinal midplane P, as are the edges 16*a*, 16*b*. This is not necessarily the case. In particular, only two contacting edges, e.g. the edges 34*a* and 16*a* need to be inclined, the other edges 34*b* and 16*b* need not be inclined.

Furthermore, it may be advantageous for the positions of the inclined plane edges 16*a* and 16*b* to be asymmetrical relative to the midplane P of the recess 16 so as to provide a keying effect distinguishing between a leading edge and a trailing edge of the link 30. The term "asymmetrical" is used concerning the positions of the plane edges to mean that the distance D1 (FIG. 2) between one of the plane edges 16*a*, 16*b* and the midplane P is greater than or less than the distance D2 between the other plane edge 16*b*, 16*a* and the midplane P.

It should also be observed that in the vicinity of its second end 34, the link 30 presents a portion of thickness that is greater than the thickness of a portion of its first end 32. This characteristic makes it possible to obtain better engagement of the second end 34 of the link in the recess 16 formed in the vane pivot 12.

The control device of the invention may also comprise a bushing 50 placed around the vane pivot 12 between the clamping cap 44 and the lip 52 of an opening in the casing 22 of the turbomachine in which the vane 10 is mounted. This bushing 50 is provided for the purpose of centering the vane pivot 12 by means of an antifriction material interposed between the opening in the casing and the vane pivot. Clearance-adjusting shim 54 is then advantageously placed between the clamping cap 44 and the bushing 50 in order to take up any axial clearance that might exist between these parts. Under such circumstances, the clamping cap 44 also bears via its periphery against the shim 54. In addition, an antifriction washer 56 may be placed between the lip 52 of the opening in the casing 22 and the base of the vane pivot 12.

What is claimed is:

1. A device for controlling a variable-angle vane for a stator of a turbomachine compressor, the device comprising a link, connection means forming a hinge between a first end of the link and a control ring, and fixing means for fixing a second end of the link on a pivot of a vane to be controlled, the device further comprising:

a radial recess formed in the vane pivot for receiving the second end of the link, said recess having at least one plane edge inclined relative to a longitudinal midplane of the recess and co-operating with a corresponding inclined edge of the second end of the link; and a clamping cap bearing against the second end of the link and on which the fixing means act, said clamping cap having an inside surface providing plane contact with the outside face of the second end of the link against which said clamping cap bears in order to maintain the second end of the link against the vane pivot without slack by means of contact between said inclined edges.

2. A device according to claim 1, wherein the radial recess formed in the vane pivot has two inclined plane edges that are symmetrical about the longitudinal midplane of the recess.

3. A device according to claim 1, wherein the radial recess formed in the vane pivot presents two inclined plane edges that are asymmetrical about the longitudinal midplane of the recess.

4. A device according to claim 1, wherein the inside surface of the clamping cap has a groove that is complementary in shape to the outside face of the second end of the link against which said clamping cap bears.

5. A device according to claim 1, wherein, at its second end, the link presents a portion of thickness that is greater than the thickness of its first end.

6. A device according to claim 1, further comprising a bushing placed around the vane pivot for centering the vane pivot in an opening in a casing.

7. A device according to claim 6, further comprising shim interposed between the clamping cap and the bushing.

8. A device according to claim 7, wherein the clamping cap also bears at its periphery against the shim.

9. A device for controlling a variable-angle vane for a stator of a turbomachine compressor, the device comprising a link, connection means forming a hinge between a first end of the link and a control ring, and fixing means for fixing a second end of the link on a pivot of a vane to be controlled, the device further comprising:

a radial recess formed in the vane pivot for receiving the second end of the link, said recess having at least one plane edge inclined relative to a longitudinal midplane of the recess and co-operating with a corresponding inclined edge of the second end of the link; and a clamping cap bearing against the second end of the link and on which the fixing means act, said clamping cap having an inside surface including a groove that is complementary in shape to the adjacent portion of the outside face of the second end of the link against which said clamping cap bears in order to maintain the second end of the link against the vane pivot without slack by means of contact between said inclined edges.

10. A turbomachine compressor stator including a plurality of control devices for variable-angle vanes according to claim 1.

* * * * *